United States Patent [19]

Gates

[11] 4,304,388

[45] Dec. 8, 1981

[54] DUAL PURPOSE FORM TIE LOCK TOOL

[75] Inventor: H. Gordon Gates, Denver, Colo.

[73] Assignee: Gates & Sons, Inc., Denver, Colo.

[21] Appl. No.: 66,012

[22] Filed: Aug. 13, 1979

Related U.S. Application Data

[63] Continuation-in-part of Ser. No. 8,195, Jan. 31, 1979, abandoned.

[51] Int. Cl.[3] ..... E04G 17/00; E04G 17/04; E04G 17/06

[52] U.S. Cl. ..... 249/219 W

[58] Field of Search ..... 249/219 W, 219 R, 25, 249/40, 45–47, 190, 191, 192, 213, 211, 38

[56] References Cited

U.S. PATENT DOCUMENTS

| | | | |
|---|---|---|---|
| 3,018,538 | 1/1962 | Gates | 249/219 W |
| 3,216,690 | 11/1965 | Jahn | 249/219 W |
| 3,235,217 | 2/1966 | Jahn | 249/219 W |
| 3,343,771 | 9/1967 | Gates | 249/219 W |
| 3,529,800 | 9/1970 | Gates | 249/219 R |
| 4,158,452 | 6/1979 | Gates | 249/219 R |

*Primary Examiner*—W. E. Hoag

*Attorney, Agent, or Firm*—Sheridan, Ross, Fields & McIntosh

[57] ABSTRACT

A form tie lock tool is provided which includes the combination of a cam lock member for use with hand set concrete panels and an anchor lock member for use with gang form concrete panels. The tool includes a frame having a first opening and a second opening formed therein. A tie lock member, including the cam lock member and the anchor lock member, is connected to the frame. A form tie having a pair of looped ends is insertable between a pair of the hand set form panels. In one embodiment, each of the looped ends is receivable through a slot in one of the hand set panels to be grippingly engaged by the cam lock member which is then rotatable in a first direction to secure the form tie between the hand set panels. Similarly, a form tie having a pair of looped ends is insertable between a pair of gang form panels. Each of the looped ends is receivable through a slot in one of the gang form panels to be grippingly engaged by the anchor lock member which is then rotatable in a second direction to secure the form tie between the gang form panels. In another embodiment, the cam lock member and anchor lock member are slidably movable toward the frame to grippingly engage the looped end of the form tie.

18 Claims, 20 Drawing Figures

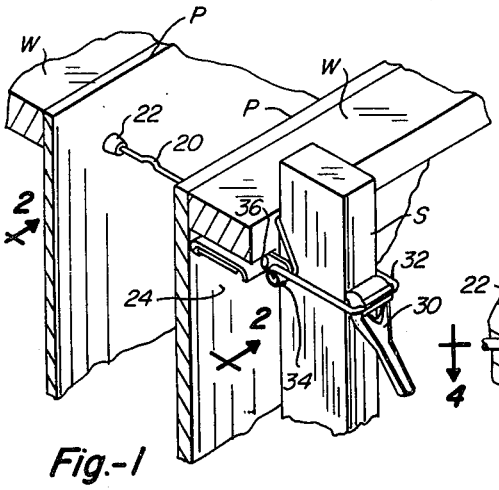
Fig.-1
Fig.-3
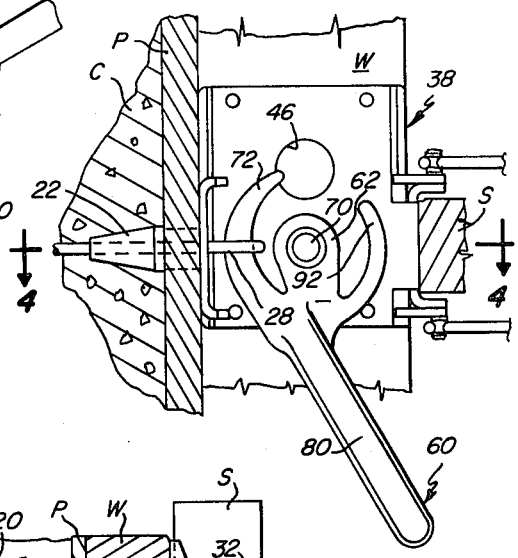
Fig.-2
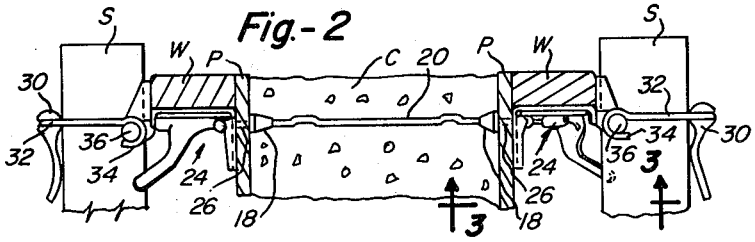
Fig.-5
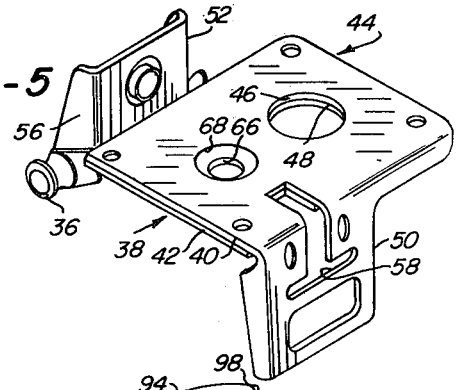
Fig.-4
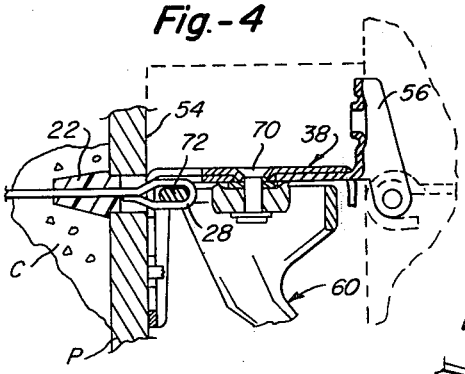
Fig.6
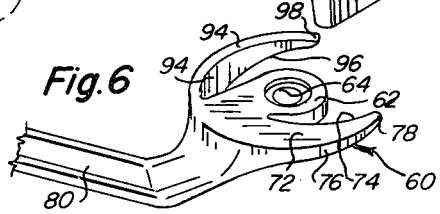

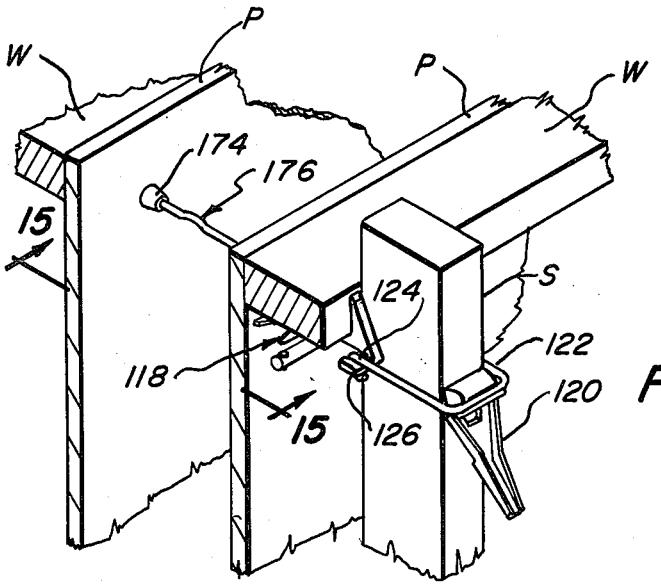
Fig_14
Fig_15
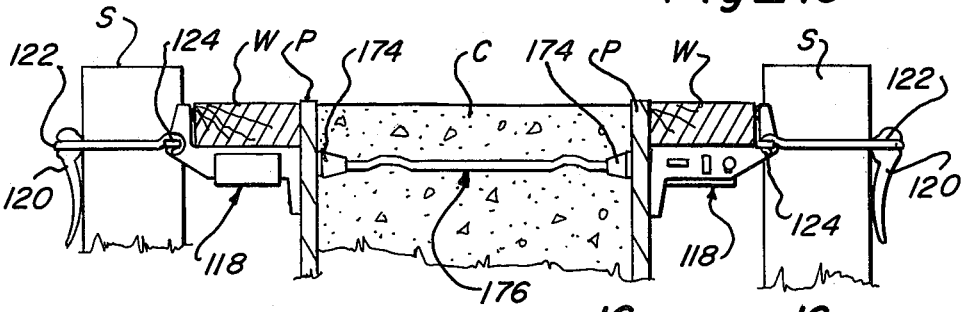
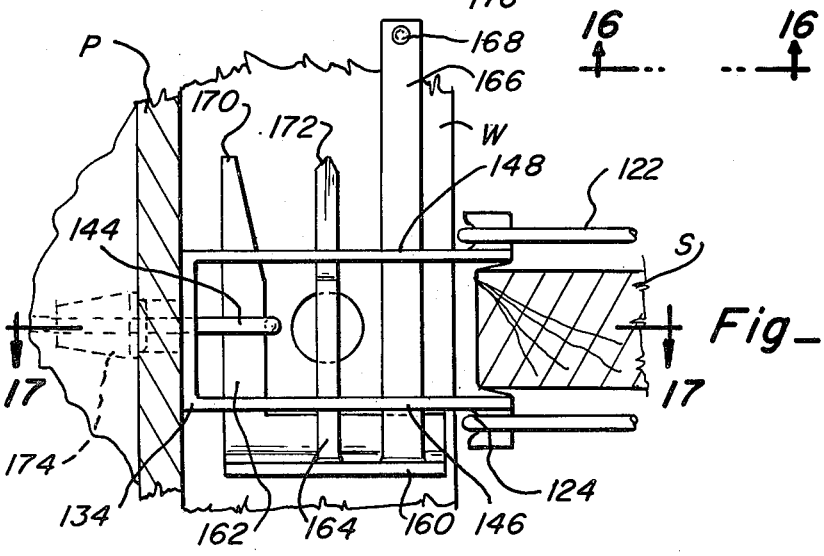
Fig_16

DUAL PURPOSE FORM TIE LOCK TOOL

DESCRIPTION

Technical Field

This application is a continuation-in-part of my copending application, Ser. No. 8,195, filed Jan. 31, 1979, abandoned. The present invention relates to a tie lock and waler clamp for use in concrete forming operations and, in particular, to a tool which is adaptable for use with both gang form panels as well as hand set panels which are utilized in the construction of concrete walls.

BACKGROUND ART

Heretofore, in the formation of concrete wall structures, two separate tools were often required to maintain the position of concrete form ties inserted between a pair of panels between which concrete was poured and allowed to set or harden. A first tool was utilized with gang form panels. Gang forming is the construction of form panels in a substantially permanent relation. This type of panel formation is provided when the form panels can be used repeatedly since other identically formed concrete walls are also required. Thus, the first tool can be permanently mounted on a waler which is securely fastened to the form panel. Such a first tool is disclosed in my U.S. Pat. No. 3,529,800 issued on Sept. 22, 1970 and entitled "Concrete Form Tie End Latch". When hand set panels were required, on the other hand, a second tool was utilized. Hand set panels are usually formed for a particular concrete requirement and are easily taken apart to be reused for different concrete forming jobs. Thus, the second tool is releasably mounted on the waler to facilitate the dismembering of the hand set panel after the concrete hardens. Such a second tool is disclosed in my U.S. Pat. No. 3,018,538 issued on Jan. 30, 1962 and entitled "Combined Tie Lock and Reinforcing Timber Clamp".

Disclosure of Invention

In accordance with this invention, a dual purpose form tie lock tool is provided having a frame and a tie lock member connected to the frame. The frame is adaptable to contact a waler which is used to reinforce a form panel. The tie lock member is movable for grippingly engaging a looped form tie through a first opening in the frame and movable also for grippingly engaging a looped form tie through a second opening in the frame.

More particularly, a frame is provided which includes a plate having an opening and a first flange also having an opening. The first flange is connected perpendicularly to a first edge of the plate. A second flange is connected perpendicularly to a second edge of the plate opposite from the plate first edge and extends in a direction such that a generally Z-shaped cross-section is formed by the interconnection of the plate and the first and second flanges.

A tie lock member or latch member is connected to the frame. In a first embodiment, the tie lock member has a pivot eye which is axially aligned with an aperture in the plate so that a pivot pin is inserted through the pivot eye and the aperture to secure the tie lock member to the plate. The tie lock member further includes a hub which surrounds the pivot eye thereof and a handle which is integral with the hub. An arcuate-shaped cam lock member is integrally connected to a first edge of the hub while an arcuate-shaped anchor lock member is integrally connected to a second edge of the hub. The cam lock member is operably rotatable in a first direction about the pivot pin to grippingly engage an elongated looped end of a form tie inserted through a slot in a form panel. The cam lock member is formed such that its height remains substantially the same while decreasing in width so as to converge to a point to readily receive the elongated loop of the form tie. Conversely, the anchor lock member is operably rotatable in a second direction about the pivot pin to grippingly engage the loop of the form tie inserted through a slot in a form panel. The anchor lock member is formed such that its width remains substantially the same while decreasing in height so as to converge to a point to readily receive the elongated loop of the form tie.

In a second embodiment of this invention, a modified form tie lock tool is provided. This tool is used to lock a form tie having a button end. This modified tool is identical in structure and operation to the first embodiment, however, in the second embodiment the cam lock member includes a pair of vertically spaced claws while the anchor lock member includes a pair of horizontally spaced claws. The button head of the form tie projects beyond the outer surface of a form panel so that the form tie enters a space formed between the claws while the button head rests flush against that surface of the claws opposite the surface adjacent the form panel. Similar to the operation of the tool of the first embodiment, the claws of the cam lock member are rotated in a first direction to grippingly engage and pull the form tie while the claws of the anchor lock member are rotated in a second direction to grippingly engage and pull the form tie.

In a third embodiment, the frame is substantially identical to the frame of the first and second embodiments but additionally includes a first ridge connected to a third edge of the plate and a second ridge connected to a fourth edge of the plate opposite the third edge. The first and second ridges extend vertically in the same direction from the plate and each includes a cam lock opening and an anchor lock opening. The tie lock member of the third embodiment includes a base member supporting a cam lock member and an anchor lock member. The tie lock member is slidably moved so that the cam lock member moves through the cam lock openings in the ridge members and outwardly adjacent the first flange opening while the anchor lock member moves through the anchor lock openings outwardly adjacent the plate opening. If the looped end of a form tie is inserted through the first flange opening, the cam lock member grippingly engages the looped end as it slidably moves adjacent the first flange opening. If the looped end of the form tie is inserted through the plate opening, the anchor lock member grippingly engages the looped end as it slidably moves adjacent the plate opening.

From the foregoing, the advantages of this invention are readily apparent. A dual tie lock tool adaptable for use with both gang form concrete panels and hand set concrete form panels is provided. The dual tie lock tool of this invention substantially eliminates the need for two separate concrete form tie locking tools. When a hand set panel is formed, the dual tie lock tool is releasably positioned on a waler so that a cam lock member grippingly holds a form tie received through a slot in the form panel. Alternatively, if it is desirable to construct a gang form panel, the dual tie lock tool may be securely positioned on the waler so that an anchor lock member grippingly engages the form tie which is received through openings in the waler and form panel. It can be appreciated that if concrete forming requirements alternate between hand set and gang form panels, the user of the tool disclosed herein may easily adapt the dual tie lock tool to meet these requirements without the additional expense of purchasing replacement tie lock tools. Thus, a building contractor may obtain the tool disclosed herein without concern that his concrete forming requirement might change from using gang form panels to hand set panels, for example. Furthermore, the dual tie lock tool of this invention is inexpensive, compact and structured for continuous and long-lasting use.

BRIEF DESCRIPTION OF THE DRAWINGS

FIG. 1 is a perspective view of a vertical section through a pair of spaced panels of the type used in forming a poured concrete wall structure showing the first embodiment of the form tie-locking tool holding a form tie in place and positioned to engage both a waler and a strongback;

FIG. 2 is a side elevational view, taken along lines 2—2 of FIG. 1, showing a pair of form tie locking tools, supporting walers and strong-backs on the two spaced form panels with a form tie inserted therebetween;

FIG. 3 is an enlarged, fragmentary view of the locking tool, taken along lines 3—3 of FIG. 2, showing details of the cam lock member gripping the looped form tie end;

FIG. 4 is a fragmentary, longitudinal section taken along lines 4—4 of FIG. 3, showing details of the cam lock member gripping the looped form tie;

FIG. 5 is an enlarged, perspective view of the frame of the locking tool;

FIG. 6 is an enlarged, perspective view of the tie lock member of the locking tool, having a portion of the handle broken away;

FIG. 14 is a perspective view of a vertical section through a pair of spaced panels of the type used in forming a poured concrete wall structure showing the third embodiment of the form tie locking tool holding a form tie in place and positioned to engage both a waler and a strong back;

FIG. 15 is a side elevational view, taken along line 15—15 of FIG. 14, showing a pair of form tie locking tools, supporting walers and strong backs on the two spaced form panels with a form tie inserted therebetween;

FIG. 16 is an enlarged, fragmentary view of the form tie locking tool, taken along line 16—16 of FIG. 15, showing details of the cam lock member gripping the looped form tie end;

BEST MODE FOR CARRYING OUT THE INVENTION

Figure 7:
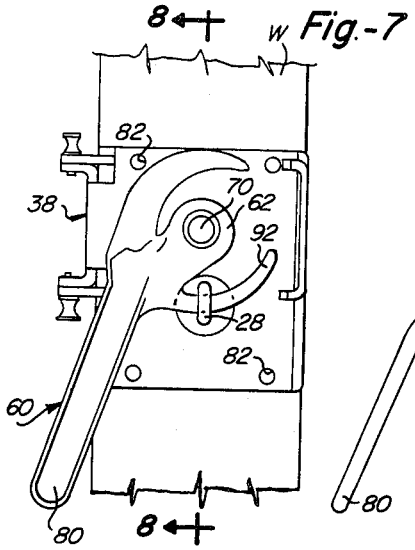
FIG. 7 is an enlarged, fragmentary view of the form tie locking tool showing the anchor lock member gripping the looped form tie end.

In accordance with this invention, a pair of conventional parallel spaced concrete forming panels P are illustrated in FIG. 1 for receiving concrete therebetween. A commonly used concrete form tie 20 having stops 22 is inserted between the panels P. In a first embodiment of this invention, the form tie 20 together with conventional walers W and conventional strong-backs S cooperate with a dual tie lock tool 24 to support the form panels P.

FIG. 2 best depicts the support provided by the tool 24 when concrete C is poured between the panels P. As can be seen, the form tie 20 is placed between the form panels P and extends through a form tie slot 26 formed in each of the panels P. A waler W abuts and reinforces each panel P and is supported by the tool 24. Each tool 24 also abuts a form panel P and engages a projecting end or loop 28 of the form tie 20 to maintain its position between the form panels P while the concrete C is poured therebetween and subsequently hardens.

When extra-high or thick concrete structures are to be constructed, it is desirable to provide additional reinforcement for the form panels P in addition to that provided by walers W. Vertically extending reinforcing members, connly termed strong-backs S, are usually provided for this purpose. A detachable strong-back clamp 30 grips a generally U-shaped wire bail 32. Hooked ends 34 of the wire bail 32 are retained by knobs 36 connected to the tool 24. The clamp 30 and wire bail 32 cooperate with tool 24 to provide additional reinforcement to the panels P by the application of a force against the strong-back S which is subsequently applied to the waler W.

Structural details of the dual tie lock tool 24 as it engages the projecting end or loop 28 of the form tie 20, as it is inserted through panel slot 26, are depicted in FIGS. 3 and 4. A generally Z-shaped frame 38, best illustrated in FIG. 5, contacts the panel P, waler W and strong-back S. The frame 38 includes a generally rectangular web 40 and a generally rectangular bracket member 42 which is parallel contiguous with web 40 and connected thereto to form plate 44. The web 40 has a generally circular opening 46 formed along the longitudinal center axis of the web 40. The bracket member 42 also has a circular opening 48 with a diameter less than the web opening 46 but axially aligned therewith for a purpose to be explained later. It being understood that plate 44 can also be a single integral piece having a first surface with a smaller opening than an opening in the second surface thereof but axially aligned therewith.

The frame 38 further includes a first flange 50 connected to a first edge of the web 40 and a second flange 52 connected to a second edge of web 40, opposite to the first edge. The first flange 50 and the second flange 52 extend in opposite directions from web 40 in substantially normal relation thereto and in parallel relation to one another. First flange 50 is adaptable to directly contact the outer surface or face of a form panel P while the second flange 52 cooperates with web 40 and form panel P to define a channel 54 sized to receive a waler W which is positioned to extend horizontally along the outer surface of the form panel P. Although a 2×4 waler is illustrated, channel 54 could be of any size to accommodate other size walers W. The second flange 52 includes knobs 36 which receive the wire bale 32 for engaging the strong-back S as previously described. Ribs 56 extend from the side edges of the second flange 52 and are spaced apart to receive the thickness of the strong-back S therebetween. The first flange 50 includes an opening 58 which is of a size to readily accept the loop form tie end 28. The first flange opening 58 can also be formed to receive other types of form ties such as the button head form tie to be discussed later.

A tie lock member or latch member 60, as best illustrated in FIG. 6, is joined to the frame 38 to engage the loop 28 of the form tie 20. In the first embodiment, the tie lock member 60 includes hub 62 in which a pivot eye 64 is centrally formed. The pivot eye 64 is axially aligned with an aperture 66 formed in the bracket member 42. Also axially aligned with the pivot eye 64 is an aperture 68 formed in the web 40. Pivot pin 70 is inserted through the pivot eye 64 and the bracket member and web apertures 66, 68 to fasten the tie lock member 60 to the plate 44. It being understood that plate 44 can also be a single, integral piece having an aperture to receive tie lock member 60 and fasten the tie lock member 60 to the plate 44.

The tie lock member 60 also includes a first or cam lock member 72 to grip the projecting ends 28 of the form ties 20 which are received through the form tie slots 26. The cam lock member 72 extends in an arcuate path from an integral connection to a first edge of hub 62 and includes an inner edge 74 and an outer edge 76 which converge together to form a pointed end 78. As seen in FIGS. 3 and 4, the looped form tie 20 is inserted through a first flange opening 58. The pointed end 78 of cam lock member 72 can then enter the loop 28 of the form tie 20 by rotating in a first direction about pivot pin 70 while the converging inner edge 74 acts as a cam surface to pull the stop 22 of the form tie 20 against the inside surface of the panel P. The cam lock member 72 also cooperates with the form tie 20 to force the first flange 50 against the outer surface of the panel P while clamping the waler W between the panel P and the second flange 52. The cam lock member 72 increases in width from pointed end 78 to its connecting point at the first edge of hub 62 while its vertical dimension or height remains substantially the same. This structural arrangement permits easy access to the form tie end loop 28 when the loop 28 is inserted through first flange opening 58.

Movement of the cam lock member 72 is provided by handle 80 which is integral therewith as well as hub 62. Handle 80 is inclined downwardly with respect to plate 44 so that the movement of the cam lock member 72 by the operator of the tool 24 is facilitated when the looped form tie 20 is to be grippingly engaged by the cam lock member 72.

Figure 8:
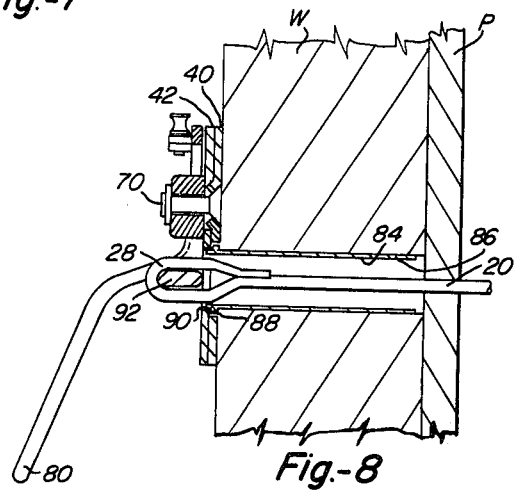
FIG. 8 is a fragmentary, longitudinal section, taken along lines 8—8 of FIG. 7, showing details of the anchor lock member gripping the looped form tie end.

The use of the second locking member of the dual tie lock tool 24 is illustrated in FIGS. 7 and 8. The frame 38 may be fastened to a waler W, shown as a 4×4, by means of bolts or screws imbedded in the waler W through bores 82. The waler W itself may also be securely attached to the outer surface of the panel P by conventional means. A drill hole 84 is centrally formed in the waler W so that the loop end 28 of the form tie 20 can conveniently pass therethrough and subsequently through the web and bracket member openings 46, 48. Rather than using a single 4×4 waler, a pair of 2×4 walers W on edge may be substituted for the single waler. The plate 44 is positioned so that it can be fastened to both 2×4 walers with a gap formed therebetween to permit the insertion of the form tie therethrough.

As shown in FIG. 8, a cylindrical sleeve 86 having a circular rim portion 88 may be removably fitted in the drilled hole 84 of the waler W. A top portion 90 of the sleeve 86 projects beyond the waler W while the rim portion 88 extends outwardly from the sleeve 86 and is positioned vertically below the sleeve top portion 90 so that it is contiguous with the form panel P. The outer diameter of the sleeve 86 substantially equals the diameter of the bracket member opening 48 while the outer diameter of the rim portion 88 together with the sleeve 86 substantially equals the web opening 46 so that placing the web and bracket member openings 46, 48 over the sleeve 86 and its rim portion 88 provides an attachment point for the plate 44 to the waler W. It being appreciated that plate 44 can be formed from a single piece rather than from web 40 and bracket member 42 connected together. In such a modification, plate 44 includes a first surface having a smaller opening than a second surface thereof so that rim portion 88 is releasably fitted between the two openings.

Referring again to FIGS. 7 and 8, the loop 28 of the form tie 20 extends beyond the waler W to be grippingly engaged by a second or anchor lock member 92. The anchor lock member 92 which is integrally connected to a second edge of hub 62 extends outwardly therefrom in an arcuate path. As seen in FIG. 6, the top edge 94 and bottom edge 96 of anchor lock member 92 converge from the second edge of hub 62 to a pointed end 98 so that the vertical dimension or height of the anchor lock number 92 gradually increases from its pointed end 98 while its width remains substantially the same. This structural form permits easy insertion of the anchor lock member 92 into the projecting end 28 of the form tie 20. Similar to the operation of the cam lock member 72, the handle 80 is rotated in a second direction, opposite to the first direction taken by the cam lock member 72, until the pointed end 98 enters the loop 28 and the camming action of the anchor lock member 92 as it moves through the loop 28 secures the form tie 20 to the form tie lock tool 24. Since the web and bracket member openings 46, 48 are substantially perpendicular to the first flange opening 58, it can be appreciated that, when form tie 20 having an elongated loop is provided for insertion through the web and bracket member openings 46 and 48, the increasing width of cam lock member 72 prevents its insertion through the elongated loop. On the other hand, the constant width of the anchor lock member 92 permits it to be easily moved through the loop 28. Conversely, the increasing height of the anchor lock member 92 prevents its insertion through an elongated looped end 28 positioned through the first flange opening 58 while the constant height of the cam lock member 72 permits it to be easily moved through such an elongated loop 28. Thus, the operator of the tool 24 can use the anchor lock member 92 only when the form tie is inserted through the web and bracket member openings 46, 48 while the cam lock member 72 is only utilized when form tie 20 is inserted through the first flange opening 58. Even if the loop 28 of the form tie 20 is greatly enlarged to accommodate both the cam lock member 72 and the anchor lock member 92 regardless of whether the form tie 20 is inserted through the first flange opening 50 or the web and bracket member openings 46, 48, continued rotation of the anchor lock member 92, so that it is able to engage the loop 28 and provide the complete camming action, is prevented because handle 80 is stopped by a first edge of flange 50 as it is rotated in the second direction. Similarly, if cam lock member 72 is rotated in its first direction to engage a looped form tie 20 extending through web and bracket member openings 46, 48, handle 80 is stopped by a second edge of flange 50 so that cam lock member 72 is unable to complete its camming action for tightly gripping the form tie 20.

Figure 12:
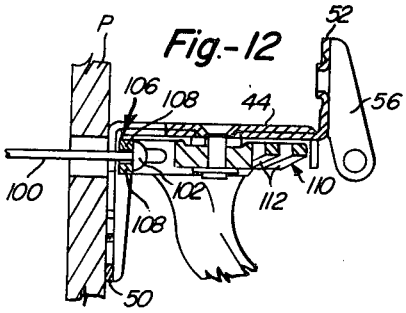
FIG. 12 is an enlarged, fragmentary, longitudinal section of the locking tool, similar to FIG. 4, but showing the claws of the cam lock member of FIGS. 9 and 10 gripping the button head form tie.
Figure 10:
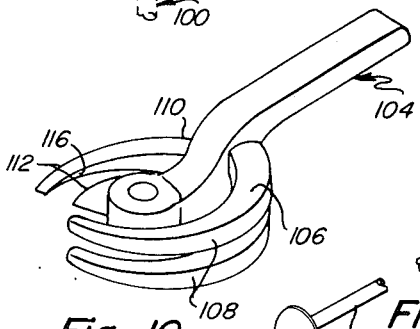
FIG. 10 is an enlarged, perspective view of the embodiment of FIG. 9.
Figure 11:
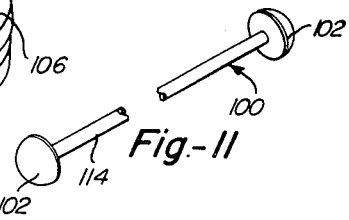
FIG. 11 is a perspective view of the button head form tie with its mid-portion cut away.

Thus far the end of the form tie 20 has been described as an elongated loop 28 but the tie lock tool 24 can be modified in forming a second embodiment of the invention to lock or clamp a form tie 100 having a button end or head 102, as shown in FIG. 11. The modified dual tie lock tool 104 is identical in structure and operation to the dual tie lock tool 24 previously described, however, in this embodiment the cam lock member includes a pair of vertically parallel spaced claws 108 while the anchor lock member includes a pair of horizontally parallel spaced claws. As shown in FIG. 12, the frame 38 contacts the panel P in a manner similar to that previously described in connection with the operation of the cam lock member 72. The button head of the form tie projects beyond the outer surface of a form panel so that the form tie enters a space formed between the claws while the button head rests flush against that surface of the claws opposite the surface of the claws adjacent the form panel. Since the dimensions of the claws 108 of the cam lock member 106 are proportional fo the cam lock member 72 previously described, the camming action previously discussed with respect to the cam lock member 72 applies to this embodiment also, that is, the cam lock member 106 rotates in a first direction to grippingly engage and pull the form tie 100.

Figure 9:
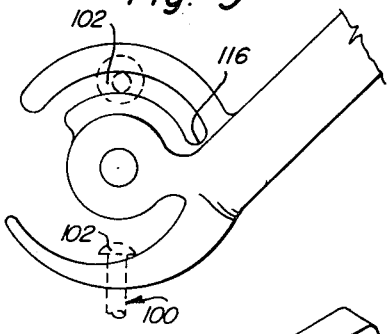
FIG. 9 is an enlarged, fragmentary, top plan view of a second embodiment of the form tie locking tool showing the tie lock member having a pair of spaced claws forming the anchor lock and cam lock members and with a concrete form tie having a button head end receivable therebetween.
Figure 13:
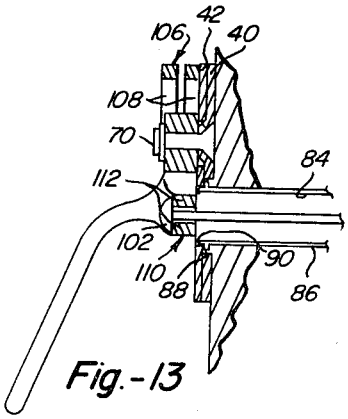
FIG. 13 is an enlarged, fragmentary, longitudinal section of the locking tool, similar to FIG. 8, but showing the claws of the anchor lock member gripping the button head form tie.

Similarly, FIGS. 9 and 13 depict the operation of the claws 112 of the anchor lock member 110 in cooperation with a button head form tie 100 inserted through a drilled hole 84 in waler W and through the web and bracket member openings 46, 48. The gripping of the button head 102 is identical to that described with respect to FIG. 12 except that the claws 112 of the anchor lock member 110 are now utilized to move in a second direction, opposite to the first direction taken by cam lock member 106, to grippingly engage and pull the form tie 100.

A third embodiment of this invention is shown in FIGS. 14–20. Similar to the first embodiment illustrated in FIGS. 1 and 2, this modified dual tie lock tool 118 is used to support form panels P when concrete C is poured therebetween as illustrated in FIGS. 14 and 15. The structure and operation of the third embodiment is substantially the same as previously described with regard to the first embodiment except for the differences pointed out in the following discussion.

Figure 18:
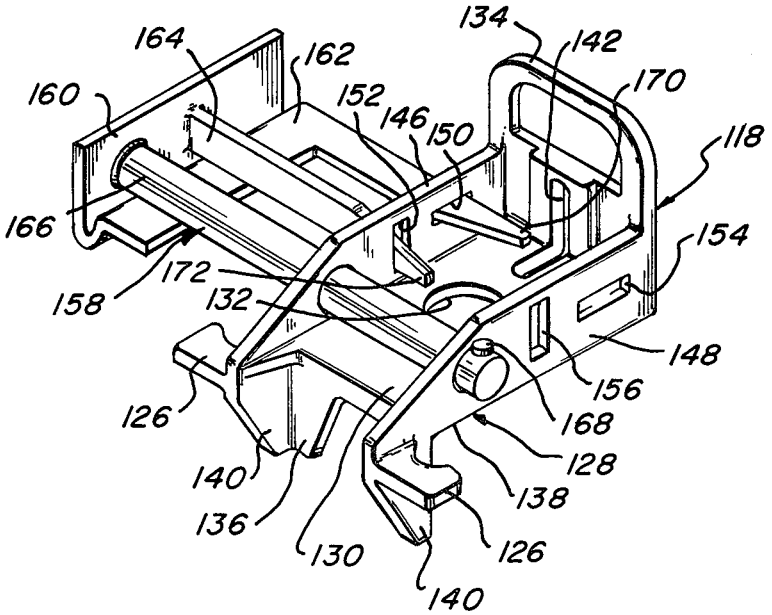
FIG. 18 is an enlarged, perspective view of the form tie locking tool showing the frame and the tie lock member slidably fastened thereto.

Duel tie lock tool 118 can be used with walers W and strong-backs S to reinforce the form panels P. A detachable strong-back 120 clamp grips a generally U-shaped wire bail 122. Hooked ends 124 of the wire bail 122 are retained by knobs 126 connected to the tool 118. The clamp 120 and wire bail 122 cooperate with tool 118 to provide additional reinforcement to the panels P by the application of a force against the strong-back S which is subsequently applied to the waler W. Structural details of the dual tie lock tool 118 are depicted in FIG. 18. A generally Z-shaped frame 128 is provided to contact the panel P, waler W and strong-back S. The frame 128 includes a plate 130 having an opening 132 and a first flange 134 connected to a first edge of plate 130 while a second flange 136 is connected to a second edge of plate 130, opposite the first edge. Like the first embodiment, the first flange 134 is adaptable to directly contact the outer surface or face of a form panel P while the second flange 136 cooperates with plate 130 and form panel P to define a channel 138 sized to receive a waler W which is positioned to extend horizontally along the outer surface of the form panel P. The second flange 136 includes the knobs 126 which receive the wire bail 122 for engaging the strong-back S as previously described. Ribs 140 extend from the side edges of the second flange 134 and are spaced apart to receive the thickness of the strong-back S therebetween. The first flange 134 includes an opening 142 which is of a size to readily accept the loop form tie end 144.

The frame 128 of the third embodiment additionally includes a first ridge 146 connected to a third edge of plate 130 and a second ridge 148 connected to a fourth edge of plate 130, opposite the third edge. First and second ridges 146, 148 extend from plate 130 in the same vertical direction. First ridge 146 includes a first cam lock opening 150 and a first anchor lock opening 152. Second ridge 148 includes a second cam lock opening 154 and a second anchor lock opening 156. First and second cam lock openings 150, 154 are coaxial while first and second anchor lock openings 152, 156 are also coaxial. Each of the first and second ridges 146, 148 also has a hole spaced from the cam and anchor lock openings. The hole of the first ridge 146 is coaxial with the hole of the second ridge 148. Tie lock member or latch member 158 of the third embodiment is connected to the frame 128 as seen in FIG. 18. Tie lock member 158 includes a base member 160 supporting a first or cam lock member 162 and a second or anchor lock member 164. A first end of rod 166 is also joined to the base member 160. Rod 166 is received through the holes of first and second ridges 146, 148 and a locking pin 168 is inserted through a hole in a second end of rod 166 to fasten the tie lock member 158 to frame 128. Cam lock member 162 has a converging first end 170 in which the width of the first end is less than the width of the remaining portions of the cam lock member 162 while the height thereof is substantially the same. Anchor lock member 164 has a converging first end 172 in which the height of the first end is less than the height of the remaining portions of the anchor lock member 164 while the width thereof is substantially the same. This structural arrangement facilitates access to the looped form tie end 144 as will be subsequently explained. The cam lock openings 150, 154 are of a dimension to readily receive cam lock member 162 therethrough. Similarly, anchor lock openings 152, 156 are of a dimension to readily receive anchor lock member 164 therethrough.

Figure 17:
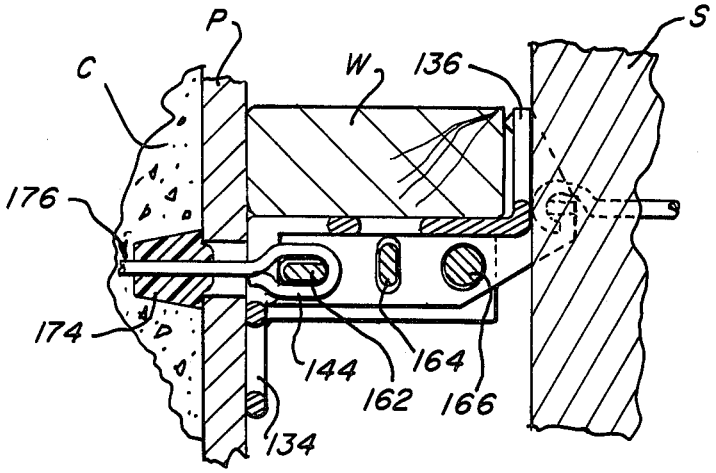
FIG. 17 is a fragmentary, longitudinal section taken along line 17—17 of FIG. 16, showing details of the cam lock member gripping the looped form tie.

Operation of the cam lock member 162 is seen in FIGS. 16 and 17. First flange 134 engages the outer surface of form panel P and second flange 136 is positioned between waler W and strong-back S. While the dual tie lock tool 118 is being positioned against the form panel P, the tie lock member 158 connected to the frame 128 is substantially positioned as shown in FIG. 18. The cam lock member 162 is located away from first flange opening 142 to permit access therethrough by looped form tie end 144. After proper positioning of the dual tie lock tool 118, tie lock member 158 is slidably and generally linearly moved in a direction toward plate 130 adjacent to and laterally spaced from first flange opening 142 so that first end 170 of cam lock member 162 engages looped form tie end 144. The converging end 170 acts as a cam to pull stop 174 of the form tie 176 against the inside surface of panel P. Continued sliding movement of tie lock member 158 results in the positioning of looped form tie end 144 around the non-converging portion of cam lock member 162, as seen in FIG. 16, while portions of cam lock member 162 are inserted through second cam lock opening 154 of second ridge 148. In this position, the cross-sectional dimension of the cam lock member 162 is substantially the same as the rectangular defined area of the looped form tie end 144 to assure a tight grip between the cam lock member 162 and the form tie 176.

Figure 19:
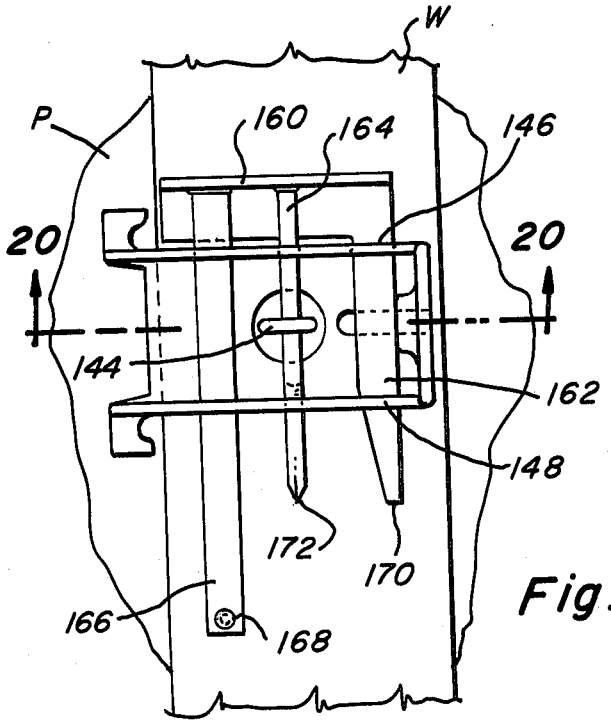
FIG. 19 is an enlarged, fragmentary view of the form tie locking tool showing the anchor lock member gripping the looped form tie end.
Figure 20:
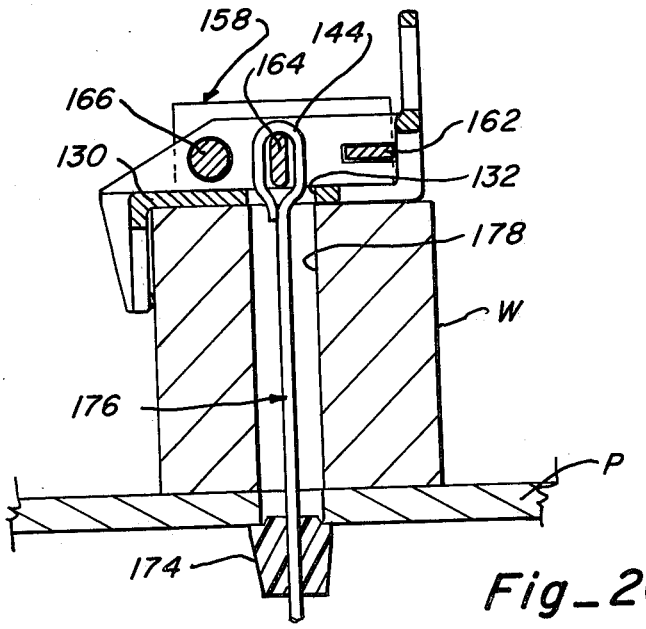
FIG. 20 is a fragmentary, lateral section taken along line 20—20 of FIG. 19, showing details of the anchor lock member gripping the looped form tie end.

The operation of the anchor lock member 164 is best depicted in FIGS. 19 and 20. The frame 128 is placed against a waler W while the waler W itself may be securely attached to the outer surface of the panel P by conventional means. A drill hole 178 is centrally formed in the waler W so that the looped form tie end 144 can conveniently pass therethrough and subsequently through the plate opening 132. Similar to the operation of the cam lock member 162, the tie lock member 158 is initially positioned to enable looped form tie end 144 to pass through plate opening 132. After inserting looped form tie end 144 through plate opening 132, tie lock member 158 is slidably and generally linearly moved in a direction toward plate 130 adjacent to and vertically spaced from plate opening 132 so that converging end 172 of anchor lock member 164 engages the looped form tie end 144. The converging end 172 acts as a cam to pull stop 174 of the form tie 176 against the inside surface of panel P. Continued sliding movement of tie lock member 158 results in the insertion of portions of anchor lock member 164 through second anchor lock opening 156 of second ridge 148 while looped form tie end 144 is positioned to surround the non-converging portion of anchor lock member 164 as seen in FIG. 20. From the description of the operation of cam and anchor lock members 162, 164, it is readily appreciated that the cam lock member 162 and anchor lock member 164 are connected to base member 160 so that one locking member does not interfere with the proper operation of the other locking member.

Based on the foregoing description, it is apparent that a form tie lock tool directed to a number of worthwhile objectives has been provided. The single tool described herein may replace the operations of two separate form tie lock tools. Furthermore, the operator of the tool can readily determine whether the cam lock or anchor lock is to be utilized in clamping the form tie to a waler for use with a particular concrete forming operation. Additionally, the dual tie lock tool is easily constructed of a rugged and durable material so that the user of the tool may repeatedly use the tool without apprehension of failure.

The invention has been described in detail with particular reference to a plurality of embodiments thereof, but it will be understood that variations and modifications can be affected within the spirit and scope of this invention.

I claim:

1. A dual purpose tie lock tool for use with both gang form panels and hand set panels in cooperation with reinforcing walers and a form tie, said tool comprising:

a frame adaptable to engage one of the walers and having a first opening with an axis and a second opening with an axis perpendicular to said axis of said first opening; and a latch member movably mounted on said frame and including a first cam lock member and a second anchor lock member, said first lock member being movable across said second opening to grippingly engage an end of the form tie disposed generally parallel to said frame and inserted through said second opening and thereby hold the form tie between the form panels and said second lock member being of a different dimension than said first lock member and movable across said first opening to grippingly engage an end of the form tie disposed generally perpendicular to said frame and inserted through said first opening of said frame and thereby hold the form tie between the form panels.

2. The tool, as claimed in claim 1, wherein:

said first lock member decreases in width to form a generally pointed end for initially receiving the end of the form tie while the height of said first lock member remains substantially the same; and said second lock member decreases in height to form a generally pointed end for initially receiving the end of the form tie while the width of said second lock member remains substantially the same.

3. A dual purpose tie lock tool for use with both gang form panels and hand set panels in cooperation with reinforcing walers and a form tie, said tool comprising:

a frame adaptable to engage one of the walers and having a first opening with an axis and a second opening with an axis perpendicular to said axis of said first opening; and a latch member;

means pivotably mounting said latch member on said frame about an axis parallel to said first opening axis, said latch member including a first arcuate lock member and a second arcuate lock member, said first lock member being rotatable about said latch member axis across said second opening in a first direction and being dimensioned to grippingly engage an end of the form tie inserted through said second opening to hold the form tie along an axis perpendicular to said axis of said first opening between the hand set form panels and said second lock member being of a different dimension than said first lock member and rotatable about said latch member axis in a second direction across said first opening to grippingly engage an end of the form tie inserted through said first opening of said frame and thereby hold the form tie between the gang form panels along an axis perpendicular to said axis of said second opening.

4. The tool, as claimed in claim 1, wherein said plate includes:

a web having an opening with an axis and an aperture and adaptable to contact one of the walers; and a bracket member contiguously connected to said web and having an aperture having an axis aligned with said web aperture axis and an opening having an axis aligned with said web opening axis so that said web and said bracket member openings together form said first opening.

5. The tool, as claimed in claim 3, wherein said frame includes:

a plate including an aperture and having said first opening formed therein and adaptable to contiguously contact one of the walers;

a first flange having said second opening formed therein and connected to a first edge of said plate in substantially perpendicular relation thereto with said axis of said second opening being perpendicular to said axis of said first opening; and a second flange extending in a direction opposite of said first flange and connected to a second edge of said plate in substantially perpendicular relation thereto.

6. The tool, as claimed in claim 5, wherein said latch member includes:

a hub located at one end of said latch member and having a first edge and a second edge and a pivot eye axially aligned with said plate aperture; and a handle integrally formed with said hub and extending therefrom and adaptable to rotate said first lock member and said second lock member; and said pivotal means includes:

a pivot pin inserted through said pivot eye and said plate aperture to secure said latch member to said plate.

7. The tool, as claimed in claim 6, wherein:

said first arcuate lock member is integrally connected to said first edge of said hub and is curved along a radius about said pivot pin and the width of said first lock member decreases from said first hub edge to a generally pointed end; and said second arcuate lock member is integrally connected to said second edge of said hub and is curved about the same radius as said first lock member and the height of said second lock member decreases from said second edge to a generally pointed end.

8. The tool, as claimed in claim 7, wherein:

said first lock member is rotatable only in a first direction across said first flange opening to cammingly receive and pull the end of the form tie to a locking position in which the form tie is fixedly held between the form panels; and said second lock member is rotatable only in a second direction, opposite to said first direction, across said opening of said plate to cammingly receive and pull the end of the form tie to a locking position in which the form tie is fixedly held between the form panels.

9. A tool, as claimed in claim 5, wherein;

said plate includes a first surface having an opening formed therein and a second surface having an opening formed therein, said second opening being of a larger size than said first opening and coaxial therewith;

a sleeve positionable in a hole formed in the waler and having a top portion extending beyond the hole and a rim portion integral with an outer edge of said sleeve below said top portion, said top portion being of substantially the same cross section as said plate first surface opening, and said rim portion together with said sleeve being of substantially the same cross section as said plate second surface opening so that said sleeve is fittingly receivable by said plate first surface and second surface openings, and a latch member connected to said plate and having a second lock member rotatable to grippingly engage the end of a form tie projecting beyond the hole formed in the waler.

10. A dual purpose tie lock tool for use with a concrete form tie having a shank and a pair of button head ends and thereby support a pair of form panels in fixed spaced relation, said tool comprising:

a frame adaptable to engage a waler and having a first opening with an axis and a second opening with an axis perpendicular to said axis of said first opening;

a latch member;

means pivotably mounting said latch member on said frame about an axis parallel to said first opening axis, said latch member including a first arcuate lock member having a first claw and a second claw vertically spaced from each other to define a gap therebetween so that the shank of the form tie which is inserted through said second opening is receivable through the gap and the button end of the form tie is contiguous with a surface of the first and second claws opposite that surface adjacent said frame second opening so that rotation of said first lock member about said latch member axis in a first direction cammingly pulls the form tie end through said second opening, and a second arcuate lock member having a first claw and a second claw horizontally spaced from each other to define a gap therebetween so that the shank of the form tie inserted through said opening is receivable through the gap and the button end of the form tie is contiguous with a surface of the claws opposite that surface adjacent said frame first opening so that rotation of said second lock member about said latch member axis in a second direction cammingly pulls the form tie end through said first opening.

11. A dual purpose tie lock tool for use with both substantially, permanently interconnected form panels and substantially, impermanently interconnected form panels in cooperation with reinforcing walers and a form tie having ends projecting through slots formed in the panels, said tool comprising:

a web to contact a surface of one of the walers and having an opening intermediate the ends thereof and an aperture spatially positioned from said web opening;

a bracket member connected to said web and having an opening with an axis, smaller in cross sectional dimension than said web opening, axially aligned with said web opening for receiving the end of a form tie and an aperture axially aligned with said web aperture;

a first flange connected to an edge of said web in substantially normal relation thereto and having an opening with an axis perpendicular to said web and bracket opening axis to receive an end of the form tie;

a second flange connected in substantially normal relation to said web and said bracket member and extending in a direction opposite that of said first flange; and a latch member pivotably mounted on a surface of said bracket member including:

a hub having a pivot eye axially aligned with said web and said bracket member apertures;

a pivot pin inserted through said pivot eye of said hub and said apertures of said web and said bracket member to releasably secure said latch member to said bracket member;

a cam lock member arcuate in shape integrally connected to a first edge of said hub and extending in a generally spiral formation with decreasing width to form a generally pointed end to receive the end of the form tie inserted through said first flange opening and disposed generally parallel to said web and said bracket member so that the form tie end is pullingly movable along said cam lock member to securely grip said form tie and force said web against the waler;

an anchor lock member arcuate in shape integrally connected to a second edge of said hub and extending in a generally spiral formation in substantially symmetric relation with said cam lock member and decreasing in height from said hub second edge to form a generally pointed end to receive the end of the form tie inserted through said web and said bracket member openings and disposed generally perpendicular to said web and said bracket member so that the form tie end is pullingly movable along said anchor lock member to securely grip said form tie and force said web against the waler; and a handle integrally connected to said hub and adapted to ratatably move both said cam lock member and said anchor lock member.

12. The tool, as claimed in claim 11, wherein:

said first lock member is of a different dimension than said second lock member.

13. The tool, as claimed in claim 11, wherein:

said first lock member is moveable in a first direction to grippingly engage the end of the form tie inserted through said second opening while said second lock member is moveable in the same first direction to grippingly engage the end of the form tie inserted through said first opening of said frame.

14. The tool, as claimed in claim 11, wherein said frame includes:

a first ridge having a first lock opening to receive said first lock member therethrough and guide the sliding movement of said first lock member adjacent said second opening of said frame so that the end of the form tie is grippingly engaged by said first lock member.

15. The tool, as claimed in claim 11, wherein said frame includes:

a first ridge and a second ridge spaced from said first ridge with said second opening of said frame interposed therebetween, each of said ridges having a first lock opening to receive said first lock member therethrough and guide the sliding movement of said first lock member adjacent said second opening of said frame so that the end of the form tie is grippingly engaged by said first lock member.

16. The tool, as claimed in claim 11, wherein said latch member further includes:

a rod slidably connected to said first ridge and spatially positioned from said first and second lock members to secure said latch member to said frame.

17. The tool, as claimed in claim 11, wherein said frame further includes:

a plate having said first opening formed therein and adaptable to contiguously contact one of the walers;

a first flange having said second opening formed therein and connected to a first edge of said plate in substantially perpendicular relation thereto; and a second flange extending in a direction opposite of said first flange and connected to a second edge of said plate in substantially perpendicular relation thereto.

18. A dual purpose tie lock for use with both gang form panels and hand set panels in cooperation with reinforcing walers and a form tie, said tool comprising:

a frame adaptable to engage one of the walers and having a first opening with an axis and a second opening with an axis perpendicular to said first opening axis; and a latch member generally linearly movable mounted on said frame and including a first lock member to grippingly engage an end of the form tie inserted through said second opening and thereby hold the form tie between the form panels and a second lock member spaced from said first lock member to grippingly engage an end of the form tie inserted through said first opening of said frame and thereby hold the form tie between the form panels.

* * * * *